United States Patent [19]

Kawabata et al.

[11] 4,255,639

[45] Mar. 10, 1981

[54] MICROWAVE OVEN WITH A PROGRAMMABLE DIGITAL CONTROL CIRCUIT

[75] Inventors: Tsuneo Kawabata, Osaka; Minoru Makita, Higashiosaka; Sigeaki Masuzawa, Yamatokoriyama, all of Japan

[73] Assignee: Sharp Kabushiki Kaisha, Osaka, Japan

[21] Appl. No.: 792,222

[22] Filed: Apr. 29, 1977

[30] Foreign Application Priority Data

Apr. 29, 1976 [JP] Japan ..... 51-49166
Apr. 30, 1976 [JP] Japan ..... 51-50606

[51] Int. Cl.[2] ..... H05B 9/06

[52] U.S. Cl. ..... 219/10.55 B; 73/352; 219/506

[58] Field of Search ..... 219/10.55 R, 10.55 F, 219/10.55 B, 10.55 E, 10.55 D, 499, 494, 506; 73/352

[56] References Cited

U.S. PATENT DOCUMENTS

| | | | |
|---|---|---|---|
| 3,859,644 | 1/1975 | Main | 219/499 X |
| 3,875,361 | 4/1975 | Fukui et al. | 219/10.55 B |
| 3,974,472 | 10/1976 | Gould, Jr. | 219/506 X |
| 3,988,577 | 10/1976 | Leitner et al. | 219/506 X |
| 4,001,536 | 1/1977 | Eberhardt | 219/10.55 B |
| 4,009,359 | 2/1977 | Tallmadge et al. | 219/10.55 B |
| 4,011,428 | 3/1977 | Fosnough et al. | 219/10.55 B |
| 4,023,004 | 5/1977 | Burke | 219/10.55 B |
| 4,035,787 | 7/1977 | Hornung | 219/10.55 B X |
| 4,038,510 | 7/1977 | White | 219/10.55 E |
| 4,054,778 | 10/1977 | Wollich | 219/494 |
| 4,056,708 | 11/1977 | Soodak et al. | 219/499 |
| 4,088,862 | 5/1978 | Austin | 219/10.55 B |

*Primary Examiner*—Arthur T. Grimley
*Attorney, Agent, or Firm*—Birch, Stewart, Kolasch and Birch

[57] ABSTRACT

A control panel including digital input means is provided in a microwave oven for introducing desired information related to a cooking time period, a cooking mode or a mean output level of a magnetron, and a temperature to be maintained. The information introduced from the control panel is stored in a digital storage means, of which output signals are applied to a digital control circuit for controlling operation of the magnetron. A temperature sensing means is provided in the microwave oven for detecting a temperature of food being cooked. A detection output of the temperature sensing means is introduced into the digital control circuit, which compares the detection output with the temperature information stored in the digital storage means for controlling operation of the magnetron. The digital input means include a defrost switch for automatically programming intermittent defrost cooking.

19 Claims, 7 Drawing Figures

(MAGNETRON POWER SUPPLY)

MICROWAVE OVEN WITH A PROGRAMMABLE DIGITAL CONTROL CIRCUIT

BACKGROUND AND SUMMARY OF THE INVENTION

The present invention relates to a microwave oven and, more particularly, to a programmable digital control circuit for allowing a user to select a cooking time period, a cooking mode, and a food temperature to be maintained.

Recently, a digital timer has been developed, wherein an oscillation circuit develops reference pulses for counting a selected time period. The digital timer is very useful for constructing a digital controlled microwave oven.

A microwave oven including a digital timer assembly is disclosed in, for example, U.S. Pat. No. 4,011,428 "MICROWAVE OVEN TIMER AND CONTROL CIRCUIT" by Robert D. Fosnough and David F. Bennet, issued on Mar. 8, 1977. However, the conventional digitalized microwave oven has only a digital timer assembly. In microwave heating cooking, it is necessary to control magnetron output energy and a food temperature at a desired value to perform preferred cooking.

Accordingly, an object of the present invention is to provide a digital control circuit for a microwave oven.

Another object of the present invention is to provide a microwave oven including a programmable digital control circuit for controlling a cooking mode, a cooking time period, and a cooking temperature.

Still another object of the present invention is to provide a digital control circuit for a microwave oven, which automatically controls intermittent defrost cooking.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a control panel is provided in a microwave oven, which includes numeral keys and function keys for introducing desired information related to a cooking time period, a cooking mode or a mean output level of a magnetron, and a food temperature to be maintained. The information introduced from the control panel is stored in a digital storage means, of which output signals are applied to a digital control circuit for controlling operation of the magnetron.

A temperature sensing means is provided in the microwave oven for monitoring the internal temperature of food while it is being cooked in the microwave oven. A detection output of the temperature sensing means is introduced into the digital control circuit, which compares the detection output with the temperature information stored in the digital storage means for controlling operation of the magnetron.

In a preferred form, the function keys include a defrost switch for conducting defrost cooking. The digital control circuit includes a programmed control circuit associated with the defrost switch for automatically performing intermittent defrost cooking.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
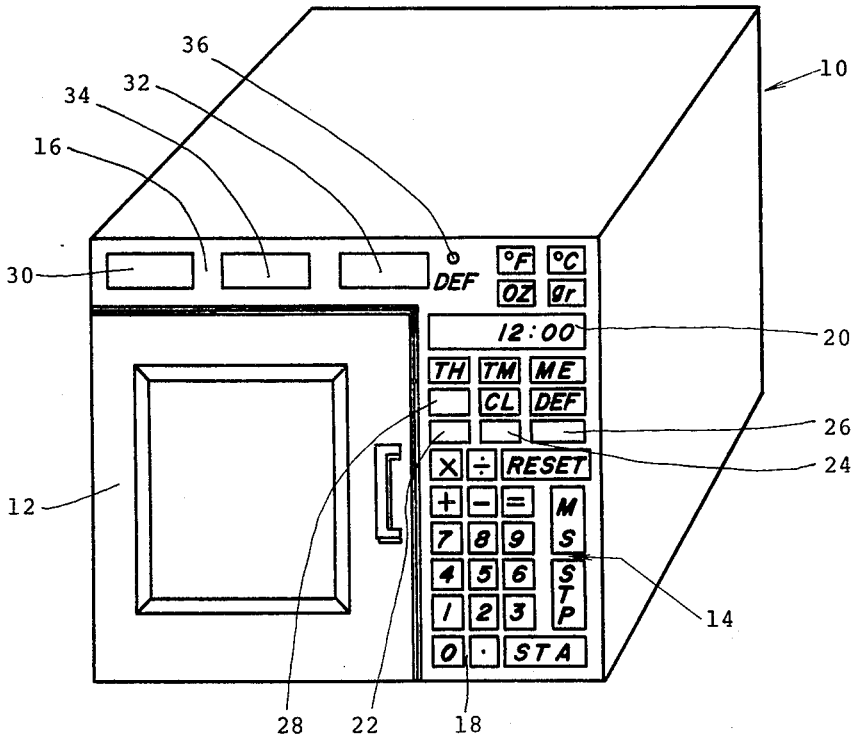
FIG. 1 is a perspective view of an embodiment of a microwave oven of the present invention.

FIG. 1 shows an embodiment of a microwave oven of the present invention. A microwave oven 10 includes an oven door 12, a control panel 14, and a display panel 16.

The control panel 14 includes numeral keys 18 and function keys for conducting arithmetic calculation and introducing cooking commands. TH is a temperature setting key for indicating that the numeral information introduced through the numeral keys 18 relates to temperature information to be maintained. TM is a time period setting key for indicating that the numeral information introduced through the numeral keys 18 relates to time information during which the cooking is to be performed. ME is a one cycle cooking instruction key for indicating that the programmed cooking stored in a digital storage means should be performed only once and the stored programme should be cleared when the one cycle cooking is completed.

More particularly, the programmed cooking is maintained in the digital storage means even after the completion of the programmed one cycle cooking when the one cycle cooking instruction key ME is not operated. Therefore, the programmed cooking can be repeated a desired number of times when the one cycle cooking instruction key ME is not operated. Contrarily, when a user desires to perform the programmed cooking only once, the one cycle cooking instruction key ME should be operated.

MS is a programme start command key for initiating the cooking operation in accordance with the programmed information stored in the digital storage means. CL is a clock calling key for indicating time information being set through the use of the numeral keys 18 at a digital display 20.

RESET is a reset key for cancelling the introduced information.

DEF is a defrost cooking command switch for performing a fixed programme suited for intermittent def: ›st cooking. Detailed operation of the defrost cooking will be described later with reference to FIG. 7. STA is a conventional start key for initiating cooking operation. STP is a stop key for terminating cooking operation when desired.

° F. and ° C. are function keys for conducting a conversion of temperature information between a centigrade unit and a fahrenheit unit in accordance with a formula $F=9/5C+32$. OZ and gr are function keys for conducting a conversion of weight information between an ounce unit and a gram unit in accordance with a formula $gr=OZ/28.35$.

The control panel 14 further includes cooking mode selection switches 22, 24, 26 and 28 and, more particularly, a 100% switch 22 for conducting cooking operation at a 100% output level, a 70% switch 24 for conducting cooking operation at a 70% output level, a 50% switch 26 for conducting cooking operation at a 50% output level, and a 30% switch 28 for conducting cooking operation at a 30% output level.

The display panel 16 includes a temperature indication section 30 for indicating set temperature information, a cooking mode indication section 32 for indicating a cooking mode selected by the cooking mode selection switches 22, 24, 26 and 28, a weight indication section 34 for indicating weight of food placed in the microwave oven 10 weighed by a suitable means, and an indication lamp 36 for indicating that the microwave oven 10 is placed in the programmed intermittent defrost cooking mode.

A temperature sensing means (not shown) is provided in the microwave oven for monitoring the internal temperature of food while it is cooked in the microwave oven. An example of the temperature sensing means is shown in U.S. Pat. No. 3,998,930 "MICROWAVE OVEN FOOD TEMPERATURE-SENSING PROBE", by Louis H. Fitzmayer and Richard E. Hornung, issued on Nov. 2, 1976.

Figure 2:
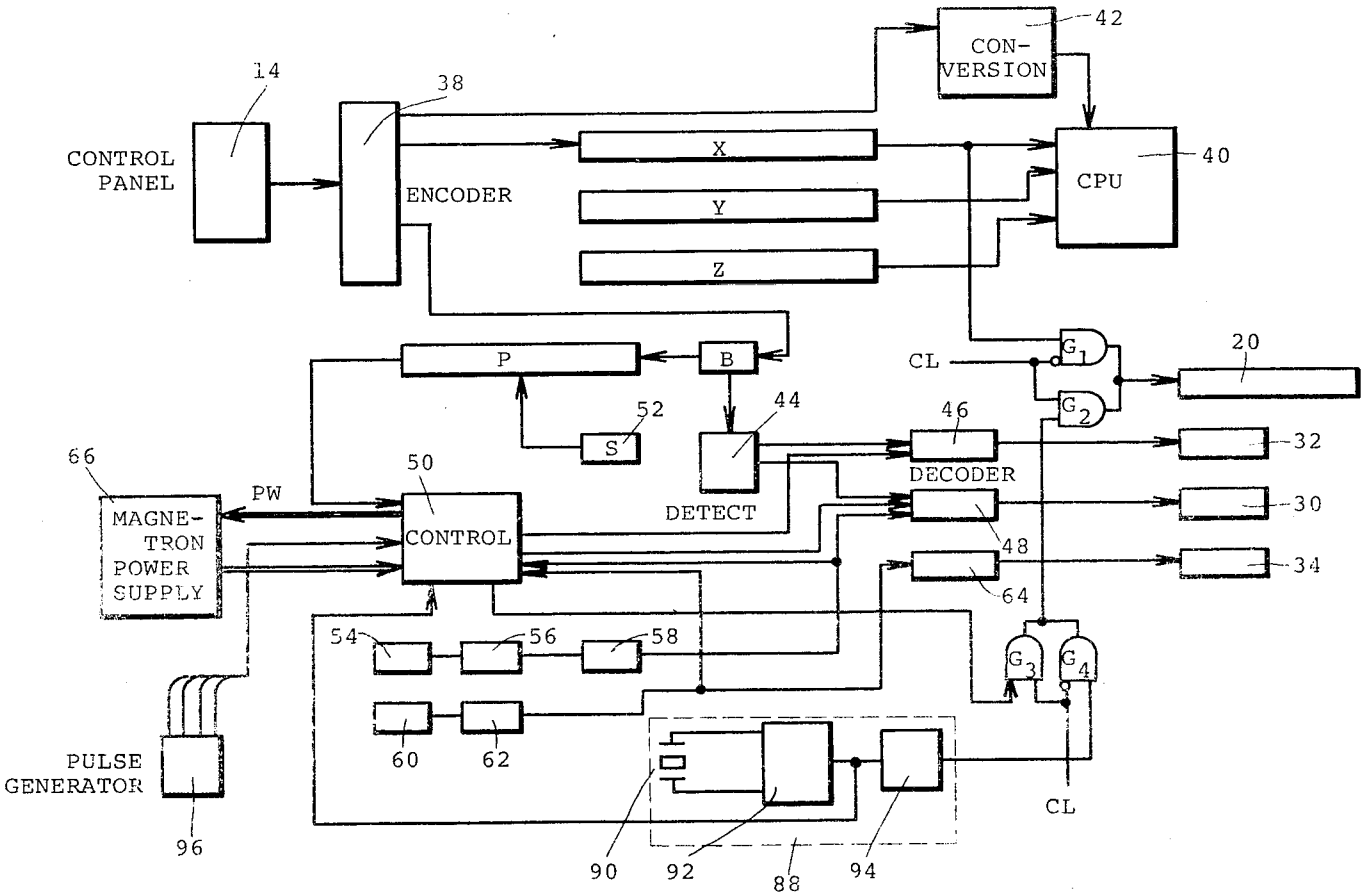
FIG. 2 is a block diagram of an embodiment of a digital control circuit included within the microwave oven of the present invention.

FIG. 2 shows an embodiment of a digital control circuit included within the microwave oven of FIG. 1.

An encoder 38 is provided in order to encode signals introduced from the control panel 14. Output signals of the encoder 38 are introduced into an indication register X, and operation registers Y and Z. A central processor unit 40 is connected to the registers X, Y and Z, whereby the conventional arithmetic calculation operation is performed by the microwave oven 10. A unit conversion circuit 42 is connected to the central processor unit 40, thereby performing the conversion between the centigrade unit and the fahrenheit unit, and between the ounce unit and the gram unit.

The output signals of the encoder 38 are also applied to a programme register P through a buffer register B. A detection circuit 44 is connected to the buffer register B for detecting the kinds of information stored in the buffer register B. When the information stored in the buffer register B relates to the cooking mode selection, the cooking mode indication section 32 is enabled through a decoder 46 in order to indicate a cooking mode or a mean output level of a magnetron selected by the cooking mode selection switches 22, 24, 26 and 28. When the information stored in the buffer register B relates to the food temperature to be maintained, the temperature indication section 30 is enabled through a decoder 48 in order to indicate the temperature selected through the control panel 14.

Contents of the programme register P are shifted in response to shift pulses developed from a step counter 52 and introduced into a control logic circuit 50, which will be described later.

A temperature detection signal developed from a food temperatue detection means 54 disposed in the microwave oven is applied to an amplifier 56, of which an output signal is applied to an A-D converter 58. An output signal of the A-D converter 58 is applied to the control logic circuit 50 and the decoder 48 in order to indicate the food temperature at the temperature indication section 30.

A weight signal developed from a weighing means 60 disposed within the microwave oven is applied to another A-D converter 62. An output signal of the A-D converter 62 is applied to the control logic circuit 50 and the weight indication section 34 through a decoder 64 in order to indicate the food weight at the weight indication section 34.

A magnetron control signal PW is applied from the control logic circuit 66 for controlling the magnetron operation.

Figure 4:
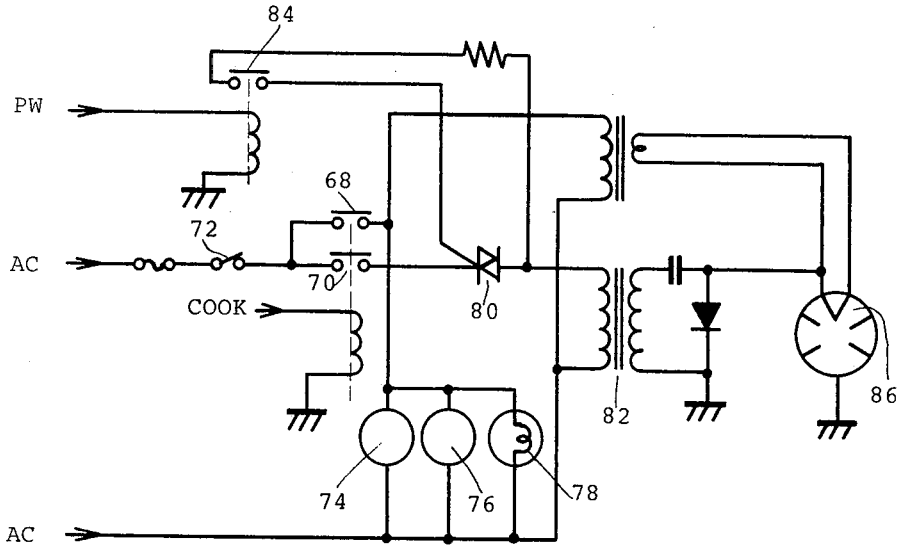
FIG. 4 is a circuit diagram of an embodiment of a magnetron power supply circuit connected to receive an output signal of the digital control circuit of FIG. 2.

FIG. 4 shows the magnetron power supply circuit 66. Switches 68 and 70 and a door switch 72 are ON when the microwave oven is placed in the cooking mode, whereby a blower motor 74, a turntable motor 76 and an illumination lamp 78 are enabled. A triac 80 connected to a primary winding of a transformer 82 is controlled by the magnetron control signal PW through a switching means 84. A magnetron 86 is connected to a secondary winding of the transformer 82 and, therefore, the magnetron operation is controlled by the magnetron control signal PW.

Referring again to FIG. 2, the digital control circuit further includes a time calculation circuit 88 having a crystal oscillator 90, a frequency divider 92 and a timepiece logic circuit 94. An output signal of the frequency divider 92 is applied to the control logic circuit 50. An output signal of the timepiece logic circuit 94 is applied to the digital display 20 via AND gates $G_4$ and $G_2$ in accordance with the operation of the clock calling key CL. 96 is a pulse generator for developing four kinds of pulse signals for controlling the mean output level of the magnetron.

Figure 3:
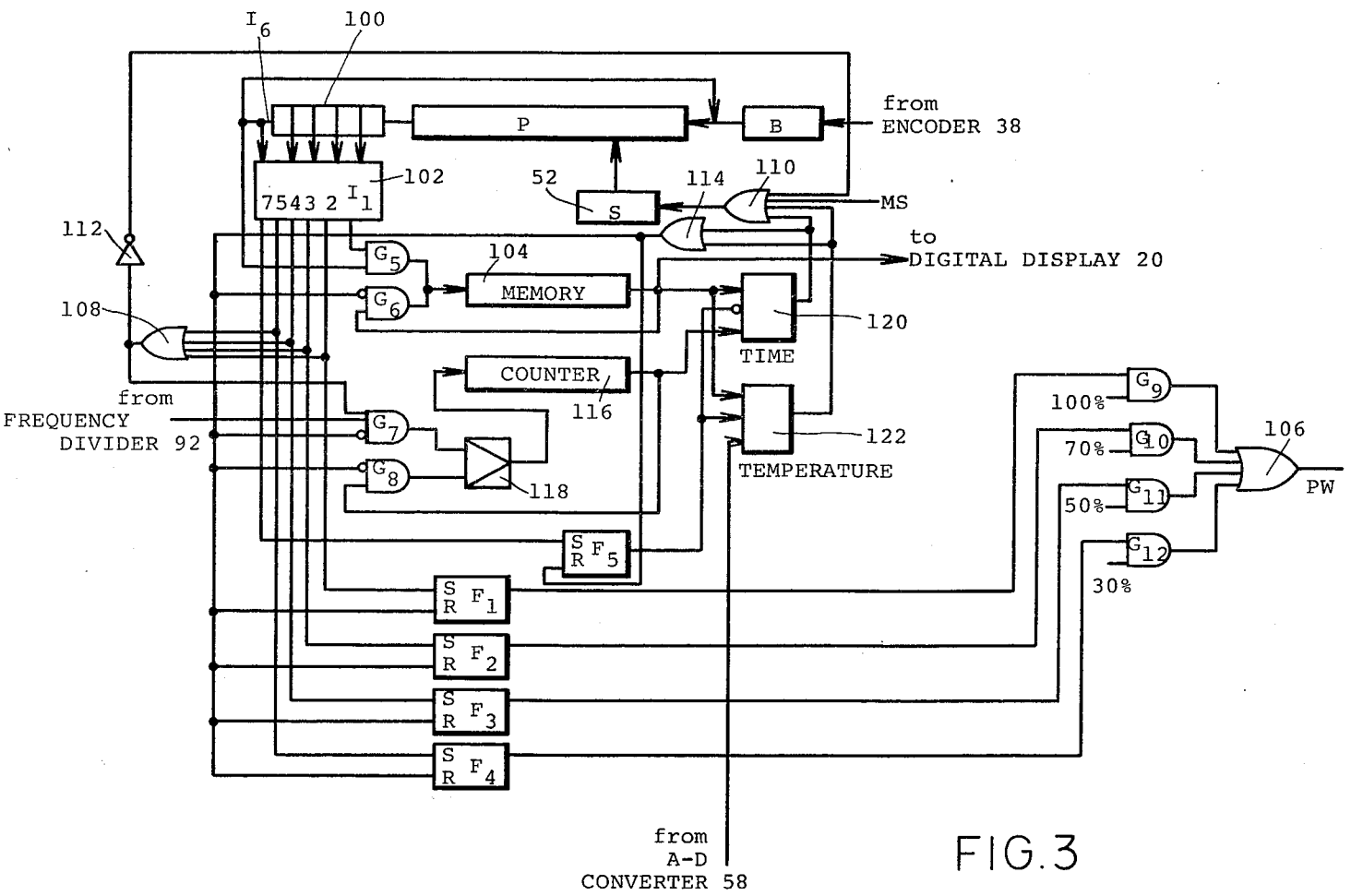
FIG. 3 is a block diagram of an embodiment of a control logic circuit included within the digital control circuit of FIG. 2.

FIG. 3 shows a detailed construction of the control logic circuit 50.

An output buffer register 100 of the programme register P develops output signals to a detection circuit 102. The detection circuit 102 functions to determine the kinds of information developed from a terminal $I_6$ of the output buffer register 100. When the signal developed from the terminal $I_6$ is numeral information, an output terminal $I_1$ develops a signal to conduct an AND gate $G_5$, whereby the numeral information stored in the output buffer register 100 is introduced into a memory 104 via the AND gate $G_5$.

When the contents of the output buffer register 100 are an instruction signal for conducting the 100% output operation related to the 100% switch 22, an output terminal $I_2$ develops an output signal to set a flip-flop $F_1$. When the contents of the output buffer register 100 are an instruction signal for conducting the 70% output operation derived from the 70% switch 24, an output terminal $I_3$ develops an output signal to set a flip-flop $F_2$. When the contents of the output buffer register 100 relate to the 50% output operation, an output terminal $I_4$ develops a signal to set a flip-flop $F_3$. When the contents of the output buffer register 100 relate to the 30% output operation, a signal is developed from an output terminal $I_5$ is set to a flip-flop $F_4$.

Set outputs of the flip-flops $F_1$ through $F_4$ are applied to AND gates $G_9$, $G_{10}$, $G_{11}$ and $G_{12}$, respectively. The AND gates $G_9$ through $G_{12}$ are also connected to receive a 100% command pulse signal, a 70% command pulse signal, a 50% command pulse signal and a 30% command pulse signal derived from the pulse generator 96, respectively.

Output signals of the AND gates $G_9$ through $G_{12}$ are applied to the magnetron power supply circuit 66 as the magnetron control signal PW via an OR gate 106.

Figure 5:
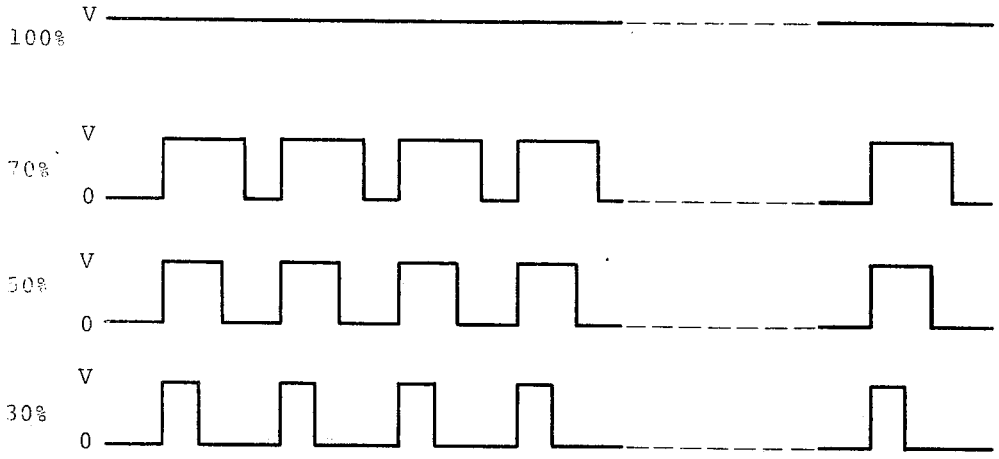
FIG. 5 is a time chart for explaining operation of a magnetron included within the microwave oven of the present invention.

FIG. 5 shows the 100% command pulse signal applied to the AND gate $G_9$, the 70% command pulse signal applied to the AND gate $G_{10}$, the 50% command pulse signal applied to the AND gate $G_{11}$, and the 30% command pulse signal applied to the AND gate $G_{12}$. The respective pulse signals have a high level time period corresponding to 100%, 70%, 50% and 30%. Each cycle of the pulse signals is selected at thirty seconds (30sec.).

The output signals of the output terminals $I_2$, $I_3$, $I_4$ and $I_5$ of the detection circuit 102 are applied to an AND gate $G_7$ through an OR gate 108, and to an OR gate 110 via an inverter 112 and the OR gate 108. The AND gate $G_7$ receives a second signal developed from the frequency divider 92, and disagreement signals of the temperature and the time interval via an OR gate 114. The AND gate $G_7$ functions to pass the second signal to a counter 116 via an adder 118 when agreement signals of the temperature and the time interval are not received. An AND gate $G_8$ performs carry operation to the contents of the counter 116.

When the contents stored in the memory 104 relate to time interval information, the contents of the counter 116 are introduced into a time agreement detection circuit 120 for comparison purposes.

The contents of the memory 104 are circulated through an AND gate $G_6$ for maintenance purposes till an agreement signal is developed from the time agreement detection circuit 120.

When the agreement signal is developed from the time agreement detection circuit 120, reset signals are applied to the flip-flops $F_1$ through $F_4$ via the OR gate 114, thereby terminating the development of the magnetron control signal PW. Moreover, the agreement signal is applied to the step counter 52 through the OR gate 110, whereby the contents of the programme register P are advanced by one step.

A temperature agreement detection circuit 122 is operative when the contents of the output buffer register 100 relate to the temperature information. When the temperature information is stored in the output buffer register 100, an output terminal $I_7$ of the detection circuit 102 develops a signal to set a flip-flop $F_5$ which functions to operate the temperature agreement detection circuit 122. An inverted set output of the flip-flop $F_5$ is applied to the time agreement detection circuit 120.

The temperature agreement detection circuit 122 receives the output signal of the A-D converter 58 associated with the food temperature detection means 54. When the agreement between the detected food temperature and the set temperature is detected by the temperature agreement detection circuit 122, the temperature agreement detection circuit 122 develops a signal for resetting the flip-flops $F_1$ through $F_5$ via the OR gate 114.

Operation of the above-mentioned microwave oven will be described below.

EXAMPLE I

Now consider that the cooking is desired to be performed in the following manner.

(1) 100% output - - - for three (3) minutes
(2) 70% output - - - for two (2) minutes
(3) 30% output - - - for five (5) minutes First, the start key STA is operated. The numeral key "3" included within the numeral keys 18, and the TM key are continuously operated to introduce the time information. Thereafter, the 100% output command switch 22 is operated to complete the introduction of the first stage. The numeral key "2", the TM key and the 70% output command switch 24 are operated to introduce the second stage. Thereafter, the numeral key "5", the TM key and the 30% output command switch 28 are continuously operated to introduce the third stage. The respective input information is displayed at the digital display 20 and the cooking mode indication section 32.

Moreover, the respective input information is introduced into the programme register P and stored therein. When the programme start command key MS is operated, the contents of the programme resister P is shifted in response to the output signal of the step of the step counter 52. When the first positioned numeral information "3" is introduced into the detection circuit 102, the AND gate $G_5$ is conducted via the output terminal $I_1$ and the numeral information developed from the output terminal $I_6$ is introduced into the memory 104.

At this moment, the remaining output terminals $I_2$ through $I_5$ and $I_7$ do not develop the output signals and, therefore, the programme resister P is shifted left by one digit through the OR gate 108, the inverter 112 and the OR gate 110. Then, the information representing the 100% output operation is positioned at the output buffer resister 100. The output terminal $I_2$ of the detection circuit 102 develops a signal to set the flip-flop $F_1$.

A signal $PW_{100}$ for conducting the 100% output magnetron operation is developed from the AND gate $G_9$ while the flip-flop $F_1$ is positioned in the set state. The signal developed from the output terminal $I_2$ is also applied to the AND gate $G_7$ via the OR gate 108, whereby the second signal is applied the adder 118 to count up the contents of the counter 116. The time agreement detection circuit 120 functions to compare the set time information stored in the memory 104 with the counted time information stored in the counter 116. When the arrangement is detected, the time agreement detection circuit 120 develops the signal to reset the flip-flop $F_1$, whereby the 100% output operation is terminated. At the same time, the contents of the programme resister P are advanced by one step.

In a same manner, the contents of the programme resister P are sequentially introduced into the output buffer resister 100 and determined by the detection circuit 102. The information of two (2) minutes is introduced into the meory 104, and the flip-flop $F_2$ is set by the signal developed from the output terminal $I_3$ of the detection circuit 102. The OR gate 106 develops the 70% output operation command till the counted time period stored in the counter 116 becomes identical with the set time period in the memory 104. The third stage is conducted in the same manner.

In the case where the one cycle cooking instruction key ME is operated, the programmed information is cleared when the third stage is completed. Contrarily, in the case where the one cycle cooking instruction key ME is not operated, the programmed information is maintained even after the completion of the third stage, and the programmed cooking is repeated by operating the programme start command key MS.

EXAMPLE II

In this example, two staged cooking is programmed.

(1) 100% output - - - till the food temperature becomes 60° C.

(2) 70% output - - - till the food temperature becomes 100° C.

At first, the numeral information sixty (60) is introduced and the temperature setting key TH is operated. And the 100% output command switch 22 is operated. Followingly, the numeral information one hundred (100) is introduced, and the temperature setting key TH and the 70% output command switch 24 are sequentially operated, whereby the cooking programme is stored in the programme resister P.

When the programme start command key MS is operated, the numeral information sixty (60) is stored in the memory 104. And the detection circuit 102 detects the temperature setting command, whereby the output terminal $I_7$ of the detection circuit 102 develops a signal to set a flip-flop $F_5$ which renders the temperature agreement detection circuit 122 operative. At this moment, the output terminals $I_2$ through $I_5$ do not develop signals and, therfore, the contents of the programme resister P is shifted to place the information of the 100% output command at the output buffer 100. The output terminal $I_2$ of the detection circuit 102 develops a signal to set the flip-flop $F_1$, whereby the 100% output operation command $PW_{100}$ is developed from the AND gate $G_9$.

The temperature agreement detection circuit 122 functions to compare the set temperature stored in the memory 104 with the food temperature detected by the temperature detection means 54. When the food temperature reaches the set temperature, the temperature agreement detection circuit 122 develops the signal to reset the flip-flop $F_1$ and $F_5$, and to advance the contents of the programme resister P by one step.

The second stage information is sequentially introduced into the output buffer resister 100, whereby the 70% output cooking is conducted till the temperature agreement detection circuit 122 detects that the food temperature reaches 100° C.

In the embodiment of FIG. 2 only one programme resister P is provided. However, a plurality of programme resisters can be provided to increase the programme capacity.

Figure 6:
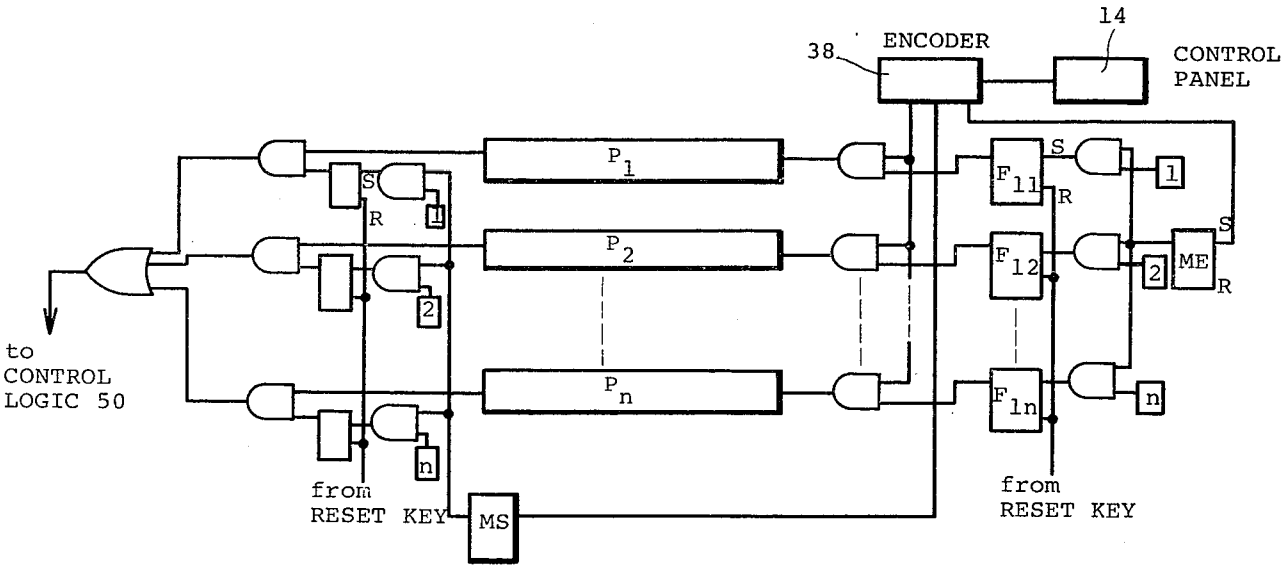
FIG. 6 is a block diagram of an essential part of another embodiment of a digital control circuit of the present invention.

FIG. 6 shows another embodiment of the digital control circuit, wherein programme resisters $P_1$ through $P_n$ are provided. Like elements corresponding to those of FIG. 2 are indicated by like numerals.

The respective resisters $P_1$ through $P_n$ are selected through the use of the numeral keys 18 included within the control panel 14.

Figure 7:
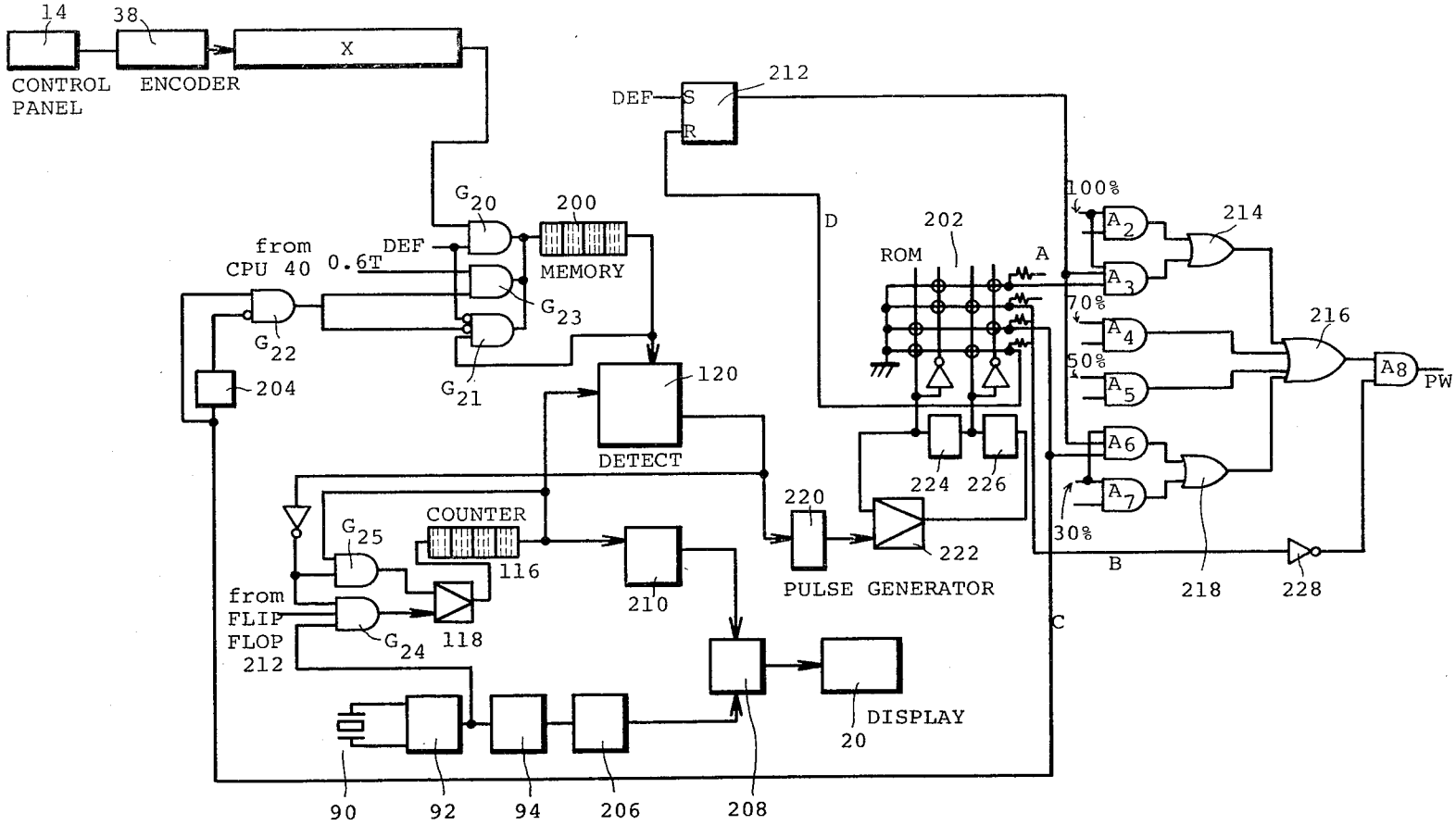
FIG. 7 is a block diagram of still another embodiment of a digital control circuit of the present invention.

FIG. 7 shows a digital control circuit for conducting the intermittent defrost cooking. Like elements corresponding to those of FIG. 2 are indicated by like numerals.

Present inventors have discovered that the defrost cooking is most preferably achieved in the following manner. At first, the 100% output cooking is performed during a T time period, and the magnetron energization is interrupted for the T time period. Thereafter, the 30% output cooking is performed for a 0.6T time period. The control circuit of FIG. 7 automatically conducts the above-mentioned defrost programme when the time period T is instructed.

The information is introduced from the control panel 14 to the resister X through the encoder 38. The contents of the resister X are introduced into a defrost time period memory 200 through an AND gate $G_{20}$. The other input terminal of the AND gate $G_{20}$ is connected to receive the defrost cooking command derived from the defrost command switch DEF. Therefore, the numeral information stored in the resister X is transferred to the defrost time period memory 200 when the defrost command switch DEF is operated. The contents of the defrost time period memory 200 are circulated for maintenance purposes through an AND gate $G_{21}$ till the first stage cooking is completed. Other input terminals of the AND gate $G_{22}$ receive an inverted signal of the defrost command switch DEF, and an inverted signal of an output signal of an AND gate $G_{22}$.

The AND gate $G_{22}$ receives an output signal C of an ROM 202 and an output signal of a flip-flop 204 which operates in response to the ROM output C. The AND gate $G_{22}$ develops a signal with a predetermined delay from the development of the ROM output C. The output signal of the AND gate $G_{22}$ is applied to an AND gate $G_{23}$ to introduce information of the 0.6T time period into the defrost time period memory 200.

The 0.6T time period information is derived from the CPU 40 which calculates the 0.6T time period in response to the time period T introduced from the control panel 14. The contents of the defrost time period memory 200 are introduced into the time agreement detection circuit 120 for comparison purposes.

The output signal of the timepiece logic circuit 94 is applied to the digital display 20 through a decoder 206 and a gate circuit 208. The gate circuit 208 functions to select the display between the set time information and the cooking time period being performed.

The second signal developed from the frequency divider 92 is applied to the adder 118 through an AND gate $G_{24}$. The contents of the counter 116 are circulated through an AND gate $G_{25}$ till an agreement is detected by the time agreement detection circuit 120. The contents of the counter 116 are also applied to the gate circuit 208 through a decoder 210.

The AND gate $G_{24}$ receives the second signal from the frequency divider 92, the time disagreement signal from the time agreement detection circuit 120, and a set output of a flip-flop 212. The flip-flop 212 is set by the operation of the defrost command switch DEF, and is reset by a signal D developed from the ROM 202.

The set output of the flip-flop 212 is also applied to AND gates $A_3$ and $A_6$. The AND gate $A_3$ functions to develop the 100% output command $PW_{100}$ through OR gates 214 and 216, and an AND gate $A_8$. The AND gate $A_6$ functions to develop 30% output command $PW_{30}$ through an OR gate 218, the OR gate 216 and the AND gate $A_8$. AND gates $A_2$ and $A_3$ receives the 100% signal shown in FIG. 5, an AND gate $A_4$ receives the 70% signal, an AND gate $A_5$ receives the 50% signal, and AND gates $A_6$ and $A_7$ receive the 30% signal.

When the agreement between the set time information stored in the defrost time period memory 200 and the counted time period stored in the counter 116 is detected by the time agreement detection circuit 120, a count pulse generator 220 is operated. The count pulse generator 220 develops one pulse when the time agreement detection circuit 120 detects the agreement once.

The pulse developed from the count pulse generator 220 is applied to an adder 222, which is connected to flip-flops 224 and 226. The flip-flops 224 and 226 form, in combination, a counter. The ROM 202 is controlled by the counter made of the flip-flops 224 and 226.

When the contents of the flip-flops 224 and 226 are "00", the ROM 202 develops a signal A to conduct the AND gate $A_3$. When the contents of the flip-flops 224 and 226 are "01", the ROm 202 develops a signal B. The signal B is applied to the AND gate $A_8$ via an inverter 228 in order to terminate the magnetron operation. When the contents of the flip-flops 224 and 226 are "10", the ROM 202 develops the signal C. which is applied to the AND gates $A_6$ and $G_{22}$ for performing the 30% output cooking. When the contents of the flip-flops 224 and 226 become "11", the signal D is developed from the ROM 202 to reset the flip-flop 212.

Operation of the digital control circuit of FIG. 7 is as follows:

A desired time interval for the 100% output cooking is introduced from the numeral keys 18 and the defrost cooking command switch DEF is operated. The introduced time period T is stored in the defrost time period memory 200 via the register X. When the programme start switch MS is operated, the counter 116 begins to count up in response to the second signal developed from the frequency divider 92. The flip-flop 212 is in the set state and the contents of the flip-flops 224 and 226 are "00" and, therefore, the 100% output cooking is performed via the AND gate $A_3$.

When the counted time period of the counter 116 reaches the set time period stored in the defrost time period memory 200, the time agreement detection circuit 120 develops a signal to change the contents of the flip-flops 224 and 226 to "01". The AND gates $G_{24}$ and $G_{25}$ become non-conductive, and the counter 116 is cleared. The magnetron operation is interrupted till the counted time period stored in the counter 116 again reaches the set time period stored in the defrost time period memory 200, since the AND gate $A_8$ is not conductive. That is, the 100% output cooking is performed during the T time period and the magnetron operation is interrupted during the T time period.

When the counted time period reaches the set time period T, the contents of the flip-flops 224 and 226 are changed to "10". The ROM 202 develops the signal C to introduce the time information of 0.6T into the defrost time period memory 200. The signal C also conducts the AND gate $A_6$ to perform the 30% output cooking till the counter 116 counts up to the 0.6T time period.

When the counter 116 reaches the 0.6T time period, the flip-flops 224 and 226 become "11" and the ROM 202 develops the signal D. The signal D resets the flip-flop 212 to complete the defrost cooking.

The invention being thus described, it will be obvious that the same way may be varied in many ways. Such variations are not to be regarded as a departure from the spirit and scope of the invention, and all such modifications are intended to be included within the scope of the following claims.

What is claimed is:

1. A programmable digital control circuit for controlling magnetron operation in a microwave oven including a cooking temperature detection means comprising:

a digital input means for introducing first digital information related to cooking modes, each mode representing a corresponding output value of microwave energy, and second digital information representative of a cooking temperature to be maintained;

digital storage means for storing said first and second digital information introduced from said digital input means;

a temperature comparing means for comparing a temperature set in said digital storage means with a cooking temperature detected by said cooking temperature detection means; and means for developing a microwave generation controlling signal in response to the combination of said first digital information representative of a selected cooking mode introduced through said digital input means and stored in said digital storage means and an output signal of said temperature comparing means; and wherein:

said digital input means further includes means for introducing digital time information representing a cooking time period;

said digital storage means stores the digital time information introduced from the digital input means thereby providing a plurality of outputs indicative of said cooking time period, said cooking mode, and said cooking temperature to be maintained;

a time interval calculation means is provided which is responsive to the introduction of said digital time information to said digital storage means to initiate a time interval count;

a time period agreement detection means is provided for comparing the cooking time period stored in said digital storage means with a time period count provided by said time interval calculation means and providing an output signal when said count represents said cooking time period;

said microwave generation controlling signal is further responsive to output signals from said time period agreement detection means;

said programmable digital control circuit further comprises detection circuit means for detecting each of a plurality of outputs from said digital storage means and for generating a plurality of unique output signals indicative of said cooking time period, a specific one of said cooking modes, and said cooking temperature, respectively;

said time interval calculation means comprises a counter means for providing said count representative of elapsed time in response to receipt of a first one of said unique output signals from said detection circuit means;

memory means are provided for storing outputs from said detection circuit means;

said cooking time period and said cooking temperature stored in said digital storage means is transferred from said digital storage means passing through said detection circuit means and is stored in said memory means;

said time period agreement detection means comparing said count of said counter means with said cooking time period stored in said memory means thereby generating a time period agreement output signal indicative of the coincidence of the count of said counter means with said cooking time period stored in said memory means;

said temperature comparing means compares said cooking temperature stored in said memory means with an output signal from said cooking temperature detection means thereby generating a temperature agreement output signal indicative of the coincidence of said cooking temperature in said memory means with the temperature indicated by said cooking temperature detection means;

flip-flop means are provided, responsive to said plurality of unique output signals from said detection circuit means for generating set signals in response thereto;

said magnetron operation controlling signal is generated in response to receipt of said set signals from said flip-flop means thereby operating said magnetron;

said flip-flop means generates reset signals in response to receipt of output signals from said time period agreement detection means or from said temperature comparing means, respectively; and said magnetron operation controlling signal is terminated in response to receipt of said reset signals from said flip-flop means.

2. The programmable digital control circuit of claim 1, which further comprises a temperature unit conversion circuit for converting temperature information introduced from said digital input means between centigrade units and fahrenheit units.

3. The programmable digital control circuit of claim 2, wherein the cooking mode is selected from a 100% output operation, a 70% output operation, a 50% output operation and a 30% output operation.

4. The programmable digital control circuit of claim 1, wherein the cooking mode is selected from a 100% output operation, a 70% output operation, a 50% output operation and a 30% output operation.

5. The invention defined in claim 1, which further includes an automatic defrost control circuit, the latter comprising:

a defrost cooking command switch;

means responsive to said command switch for applying a 100% output command to a said magnetron during a time interval received from said input means and stored in said storage means;

means for interrupting magnetron operation during a predetermined time period associated with said stored time interval after completion of the generation of said 100% output command; and means for subsequently activating the said magnetron at a level less than the 100% output level during a time period shorter than said stored time interval.

6. The invention defined in claim 5, which further comprises a temperature unit conversion circuit for converting temperature information introduced from said digital input means between centrigrade units and fahrenheit units.

7. The invention claim 1, in combination with a microwave oven.

8. A programmable digital control circuit for controlling magnetron operation in a microwave oven including a food temperature detection means comprising:

an input means for introducing digital information representing a cooking time period, a cooking mode, and a food temperature to be maintained;

storage means for storing the digital information introduced from the input means;

a time interval calculation means responsive to the introduction of digital information to said storage means for initiating a time interval count;

a time period agreement detection means for comparing the cooking time period stored in said storage means with a time period count provided by said time interval calculation means and providing a representative output;

a temperature agreement detection means for comparing a set food temperature stored in said storage means with a food temperature detected by said food temperature detection means and providing an output signal upon coincidence therebetween; and means for developing a magnetron operation controlling signal in response to a selected cooking mode, to output signals from said temperature agreement detection means and to output signals from said time period agreement detection means.

9. The programmable digital control circuit of claim 8 which further comprises a temperature unit conversion circuit for converting temperature information introduced from said input means between centigrade units and fahrenheit units.

10. The invention defined in claim 8, which further includes an automatic defrost control circuit, the latter comprising:

a defrost cooking command switch;

means responsive to said command switch for applying a 100% output command to a said magnetron during a time interval received from said input means and stored in said storage means;

means for interrupting magnetron operation during a predetermined time period associated with said stored time interval after completion of the generation of said 100% output command; and means for subsequently activating the said magnetron at a level less than the 100% output level during a time period shorter than said stored time interval.

11. The invention of claim 8, in combination with a microwave oven.

12. A programmable digital control circuit for controlling magnetron operation in a microwave oven including a food temperature detection means comprising:

an input means for introducing digital information representing a cooking time period, a cooking mode, and a food temperature to be maintained;

storage means for storing the digital information introduced from the input means;

a time interval calculation means responsive to the introduction of digital information to said storage means for initiating a time interval count;

a time period agreement detection means for comparing the cooking time period stored in said storage means with a time period count provided by said time interval calculation means and providing an output signal when said count represents said cooking time period;

a temperature agreement detection means for comparing a set food temperature stored in said storage means with a food temperature detected by said food temperature detection means and providing an output signal upon coincidence therebetween;

means for developing a magnetron operation controlling signal in response to a selected cooking mode and output signals from the time period agreement detection means and the temperature agreement detection means; and an automatic defrost control circuit, comprising:

a defrost cooking command switch;

means responsive to said command switch for applying a 100% output command to a said magnetron during a time interval received from said input means and stored in said storage means;

means for interrupting magnetron operation during a predetermined time period associated with said stored time interval after completion of the generation of said 100% output command; and means for subsequently activating the said magnetron at a level less than the 100% output level during a time period shorter than said stored time interval.

13. A programmable digital control circuit in accordance with claim 12, wherein: said storage means provides a plurality of outputs indicative of said cooking time period, said cooking mode, and said food temperature to be maintained;

said programmable digital control circuit further comprises detectiong circuit means for detecting each of said plurality of outputs from said storage means and for generating a plurality of unique output signals indicative of said cooking time period, a specific one of said cooking modes, and said food temperature, respectively;

said time interval calculation means comprises a counter means for providing said count representative of elapsed time in response to receipt of a first one of said unique output signals from said detection circuit means;

a memory means is provided for storing outputs from said detection circuit means;

said cooking time period and said food temperature stored in said storage means is transferred from said storage means, passes through said detection circuit means and is stored in said memory means;

said time period agreement detection means compares the count of said counter means with said cooking time period stored in said memory means thereby generating a time period agreement output signal indicative of the coincidence of the count of said counter means with said cooking time period stored in said memory means;

said temperature agreement detection means compares said food temperature stored in said memory means with an output signal from said food temperature detection means thereby generating a temperature agreement output signal indicative of the coincidence of said food temperature in said memory means with the temperature indicated by said food temperature detection means;

flip-flop means are provided, responsive to said plurality of unique output signals from said detection circuit means for generating set signals in response thereto;

said magnetron operation controlling signal is generated in response to receipt of said set signals from said flip-flop means thereby operating said magnetron;

said flip-flop means generates reset signals in response to receipt of output signals from said time period agreement detection means or from said temperature agreement detection means, respectively; and said magnetron operation controlling signal being terminated in response to receipt of said reset signals from said flip-flop means.

14. A programmable digital control circuit in accordance with claim 13, wherein said automatic defrost circuit further comprises means for loading said time interval received from said input means, said predetermined time period associated with said stored time interval after completion of the generation of said 100% output command and said time period shorter than said stored time interval into a defrost time period memory means in response to actuation of said defrost cooking command switch;

wherein said means for applying a 100% output command to said magnetron is energized in response to actuation of said defrost cooking command switch thereby generating said 100% output command generating said magnetron operation controlling signal;

wherein said means for interrupting magnetron operation comprises:

first counter means responsive to actuation of said defrost cooking command switch for providing a count of the elapsed time since actuation of said defrost cooking command switch;

detection means for comparing the count of said first counter means with said time interval received from said input means and loaded into said defrost time period memory means and for generating a first coincidence output signal indicative of the coincidence between said time interval and the count of said first counter means;

second counter means responsive to said first coincidence output signal for generating a first count signal indicative of the occurrence of said first coincidence output signal;

gating means responsive to said first count for terminating said magnetron operation controlling signal;

wherein said means for subsequently activating the said magnetron comprises:

means for resetting said first counter means to provide a subsequent count of the elapsed time subsequent to reset;

said detection means comparing the subsequent count of said first counter means with said predetermined time period stored in said defrost time period memory thereby generating a second coincidence output signal indicative of the coincidence between the subsequent count of said first counter means and said predetermined time period stored in said defrost time period memory;

said second counter means generating a second count signal in response to said second coincidence output signal, said second count signal energizing said means for activating the said magnetron at a level less than the 100% output level thereby generating said magnetron operation controlling signal at a power level equal to said level less than the 100% output level; and said automatic defrost control circuit further comprising:

means for terminating the activation of said magnetron after completion of the automatic defrost control cycle associated with said automatic defrost control circuit;

wherein said means for terminating the activation of said magnetron comprises:

means for causing a second reset of said first counter means in response to energization of said magnetron at said level less than the 100% output level to provide a second subsequent count of the elapsed time since said second reset of said first counter means;

said detection means comparing the second subsequent count of said first counter means with said time period shorter than said stored time interval stored in said defrost time period memory thereby generating a third coincidence output signal indicative of the coincidence between the second subsequent count of said first counter means and said shorter time period stored in said time period memory; and said second counter means generating a third count signal in response to said third coincidence output signal, said third count signal deactivating said defrost cooking command switch thereby terminating said magnetron operation controlling signal.

15. A programmable digital control circuit for controlling microwave generation operation in a microwave oven in response to the presence of specific programmed instructions in said digital control circuit, said digital control circuit including a cooking temperature detection means for detecting the cooking temperature of food undergoing cooking in said microwave oven, comprising:

a digital control logic circuit means for generating a magnetron operation controlling signal thereby energizing a magnetron in said microwave oven in accordance with said specific programmed instructions introduced to said digital control logic circuit;

a digital temperature indication means for indicating a set cooking temperature introduced to said digital control logic circuit included with said specific programmed instructions;

means for applying an output signal of said cooking temperature detection means to said digital control logic circuit means;

means for activating said digital temperature indication means to indicate said set cooking temperature;

said digital control circuit controlling microwave generation operation in said microwave oven in accordance with information introduced into said digital control logic circuit from said cooking temperature detection means; and an automatic defrost control circuit, comprising:

a defrost cooking command switch;

means responsive to said command switch for applying a 100% output command to a said magnetron during a time interval received from said input means and stored in said storage means;

means for interrupting magnetron operation during a predetermined time period associated with said stored time interval after completion of the generation of said 100% output command; and means for subsequently activating the said magnetron at a level less than the 100% output level during a time period shorter than said stored time interval.

16. The invention defined in claim 15, which further comprises an A-D converter disposed between said cooking temperature detection means and said digital control logic circuit for transmitting cooking temperature information from one to the other.

17. A programmable digital control circuit in accordance with claim 15, wherein said automatic defrost control circuit further comprises means for loading said time interval received from said input means, said predetermined time period associated with said stored time interval after completion of the generation of said 100% output command and said time period shorter than said stored time interval into a defrost time period memory means in response to actuation of said defrost cooking command switch;

wherein said means for applying a 100% output command to said magnetron is energized in response to actuation of said defrost cooking command switch thereby generating said 100% output command, which comprises said magnetron operation controlling signal;

wherein said means for interrupting magnetron operation comprises:

first counter means responsive to actuation of said defrost cooking command switch for providing a count of the elapsed time since actuation of said defrost cooking command switch;

detection means for comparing the count of said first counter means with said time interval received from said input means and loaded into said defrost time period memory means and for generating a first coincidence output signal indicative of the coincidence between said time interval and the count of said first counter means;

second counter means responsive to said first coincidence output signal for generating a first count signal indicative of the occurrence of said first coincidence output signal;

gating means responsive to said first count for terminating said magnetron operation controlling signal;

wherein said means for subsequently activating the said magnetron comprises:

means for resetting said first counter means to provide a subsequent count of the elapsed time subsequent to said reset;

said detection means comparing the subsequent count of said first counter means with said predetermined time period stored in said defrost time period memory thereby generating a second coincidence output signal indicative of the coincidence between the subsequent count of said first counter means and said predetermined time period stored in said defrost time period memory;

said second counter means generating a second count signal in response to said second coincidence output signal, said second count signal energizing said means for activating the said magnetron at a level less than the 100% output level thereby generating said magnetron operation controlling signal to effect a power level in said magnetron equal to said level less than the 100% output level;

wherein said automatic defrost control circuit further comprises:

means for terminating the activation of said magnetron after completion of the automatic defrost control cycle associated with said automatic defrost control circuit; and wherein said means for terminating the activation of said magnetron comprises:

means for causing a second reset of said first counter in response to energization of said magnetron at said power level less than the 100% output level to provide a second subsequent count of the elapsed time since said second reset of said first counter means;

said detection means comparing the second subsequent count of said first counter means with said time period shorter than said stored time interval stored in said defrost time period memory thereby generating a third coincidence output signal indicative of the coincidence between the second subsequent count of said first counter means and said shorter time period stored in said time period memory; and said second counter means generating a third count signal in response to said third coincidence output signal, said third count signal deactivating said defrost cooking command switch thereby terminating said magnetron operation controlling signal.

18. A programmable digital control circuit for controlling microwave generation operation in a microwave oven in response to the presence of specific programmed instructions in said digital control circuit, said digital control circuit including a cooking temperature detection means for detecting the cooking temperature of food undergoing cooking in said microwave oven, comprising:

a digital control logic circuit means for generating a magnetron operation controlling signal thereby energizing a magnetron in said microwave oven in accordance with said specific programmed instructions introduced to said digital control logic circuit;

a digital temperature indication means for indicating a set cooking temperature introduced to said digital control logic circuit included with said specific programmed instructions;

means for applying an output signal of said cooking temperature detection means to said digital control logic circuit means;

means for activating said digital temperature indication means to indicate said set cooking temperature;

said digital control circuit controlling microwave generation operation in said microwave oven in accordance with information introduced into said digital control logic circuit from said cooking temperature detection means;

a temperature unit conversion circuit for converting temperature information introduced from said digital input means between centigrade units and fahrenheit units;

an input means for introducing digital information relating to a cooking time period, a selected cooking mode, and a food temperature to be maintained; and storage means for storing said digital information introduced from the input means, said storage means providing a plurality of outputs indicative of said cooking time period, said cooking mode and said food temperature to be maintained;

a detection circuit means responsive to said plurality of outputs from said storage means for detecting each of said plurality of outputs from said storage means and for genearating a plurality of unique signals indicative of said cooking time period, a specific one of said cooking modes, or said food temperature, respectively;

flip-flop means responsive to said plurality of unique output signals from said detection circuit means for generating set signals in response thereto; and further wherein:

said digital control logic circuit associated with said digital control circuit comprises a time interval calculation means responsive to the introduction of said digital time information to said digital storage means to initiate a time interval count;

a time period agreement detection means for comparing the cooking time period stored in said storage means with the time period counted by said time interval calculation means;

a temperature agreement detection means for comparing said food temperature stored in said storage means with said food temperature detected by said cooking temperature detecting means;

means for developing a magnetron operation controlling signal in response to said selected cooking mode introduced into said storage means via said input means and output signals from the time period agreement detection means and the temperature agreement detection means thereby activating a magnetron in response thereto;

said time interval calculation means comprises a counter means for periodically counting the elapsed time in response to receipt of each of said unique output signals from said detection circuit means;

said cooking time period and said food temperature stored in said storage means are transferred from said storage means and stored into a memory means via said detection circuit means;

said time period agreement detection means compares the count of said counter means with said cooking time period stored in said memory means thereby generating a time period agreement output signal indicative of the coincidence of the count of said counter means with said cooking time period stored in said memory means;

said temperature agreement detection means compares said food temperature stored in said memory means with an output signal from said cooking temperature detection means and generates a temperature agreement output signal indicative of the coincidence of said food temperature in said memory means with the temperature indicated by said cooking temperature detection means;

said magnetron operation controlling signal is generated in response to receipt of said set signals from said flip-flop means thereby operating said magnetron;

said flip-flop means generates reset signals in response to receipt of either of said time period agreement output signal or said temperature agreement output signal, respectively; and said magnetron operation controlling signal is terminated in response to receipt of said reset signals from said flip-flop means.

19. The invention defined in claim 18 wherein the cooking mode is selected from a 100% output operation, a 70% output operation, a 50% output operation and a 30% output operation.

* * * * *